US008505717B2

(12) United States Patent
Urf et al.

(10) Patent No.: US 8,505,717 B2
(45) Date of Patent: Aug. 13, 2013

(54) ARRANGEMENT FOR DISPOSING OF CIGARETTE AND CIGARILLO BUTTS

(75) Inventors: Alfred Urf, Klagenfurt (AT); Josef Ressi, Klagenfurt (AT)

(73) Assignee: Ciggybag GmbH, Klagenfurt am Worthersee (AT)

( * ) Notice: Subject to any disclaimer, the term of this patent is extended or adjusted under 35 U.S.C. 154(b) by 0 days.

(21) Appl. No.: 12/681,162

(22) PCT Filed: Oct. 1, 2008

(86) PCT No.: PCT/AT2008/000352

§ 371 (c)(1),
(2), (4) Date: Apr. 1, 2010

(87) PCT Pub. No.: WO2009/043072

PCT Pub. Date: Apr. 9, 2009

(65) Prior Publication Data

US 2010/0224514 A1 Sep. 9, 2010

(30) Foreign Application Priority Data

Oct. 1, 2007 (AT) ..... A 1042/2008
Oct. 1, 2007 (AT) ..... A 1043/2008

(51) Int. Cl.
*B65D 33/00* (2006.01)

(52) U.S. Cl.
USPC ..... 206/246

(58) Field of Classification Search
USPC ..... 206/554, 246, 242, 135, 136
See application file for complete search history.

(56) References Cited

U.S. PATENT DOCUMENTS

| | | | | | |
|---|---|---|---|---|---|
| 1,007,918 | A * | 11/1911 | Chambers | 229/400 |
| 3,143,206 | A * | 8/1964 | Sullins | 206/246 |
| 3,404,770 | A * | 10/1968 | Peery | 206/246 |
| 3,561,670 | A * | 2/1971 | Segal | 383/11 |
| 4,453,649 | A * | 6/1984 | Origuchi | 221/26 |
| 4,961,496 | A * | 10/1990 | Focke et al. | 206/246 |
| 5,167,377 | A | 12/1992 | Chalmers | |
| 5,464,093 | A * | 11/1995 | Hogan | 206/265 |
| 5,992,621 | A * | 11/1999 | Grant et al. | 206/246 |
| 6,398,030 | B1 | 6/2002 | Smith et al. | |
| 7,036,701 | B2 * | 5/2006 | Garcia | 225/1 |
| 2004/0087920 | A1 * | 5/2004 | Etheredge, III | 604/332 |
| 2004/0108229 | A1 * | 6/2004 | Singh | 206/216 |
| 2006/0051457 | A1 | 3/2006 | Bougoulas et al. | |
| 2008/0032191 | A1 * | 2/2008 | Kennedy et al. | 429/185 |

FOREIGN PATENT DOCUMENTS

| | | |
|---|---|---|
| DE | 71 03 436 | 4/1971 |
| DE | 20 2005 014 517 | 1/2007 |
| GB | 2 139 871 | 11/1984 |
| JP | 2006248543 A | 9/2006 |

(Continued)

OTHER PUBLICATIONS

International Search Report dated Feb. 2, 2009, from corresponding PCT application.

(Continued)

*Primary Examiner* — Jacob K Ackun
(74) *Attorney, Agent, or Firm* — Young & Thompson

(57) ABSTRACT

An arrangement for accepting cigarette or cigarillo butts and optionally also cigarette and cigarillo ashes includes a strip (1) with at least two bags (3) which are connected to one another so as to be separable along perforations (7) and tear-off aids (4). The strip (1) can be stored in a pack of cigarettes or cigarillos in a rolled-up or folded manner.

14 Claims, 3 Drawing Sheets

(56) References Cited

FOREIGN PATENT DOCUMENTS

| | | | |
|---|---|---|---|
| WO | 99/20544 | | 4/1999 |
| WO | 9920544 | A1 | 4/1999 |
| WO | 01/47380 | | 7/2001 |
| WO | 2007067116 | A1 | 6/2007 |

OTHER PUBLICATIONS

Russian Office Action in Application No. 2010117667.

Translation of Japanese Office Action dated Jun. 12, 2012, from corresponding JP application.

* cited by examiner

ARRANGEMENT FOR DISPOSING OF CIGARETTE AND CIGARILLO BUTTS

The invention relates to an arrangement for handling cigarette and cigarillo butts.

For smokers of cigarettes and cigarillos, the problem often arises of what they are to do with the butts of smoked cigarettes or cigarillos when no ashtray is available. Often, the cigarette or cigarillo butts are then simply discarded, which is not only unsanitary and contributes to pollution of the environment, but rather also entails the danger that the discarded cigarette or cigarillo butts, if they have not been properly extinguished, can trigger a fire, in particular if cigarette or cigarillo butts are discarded in the great outdoors.

The object of the invention is to provide a remedy here.

This object is achieved with an arrangement that has the features of Claim 1.

Preferred and advantageous configurations of the invention are the subjects of the subclaims.

The arrangement according to the invention has bags into which cigarette or cigarillo butts can be put and stored therein until they can be properly disposed of.

For example, the butt-filled bags of the arrangement according to the invention can be kept in the cigarette pack itself until they are disposed of.

The invention also makes it possible to store the strips of the arrangement as compactly as possible with at least two bags that are joined together in the cigarette pack, so that the bags are then always available and within reach if they are required to store a cigarette or cigarillo butt until it can be properly disposed of.

Other details and features of the invention follow from the description below of preferred embodiments with reference to the drawings.

Figure 1:
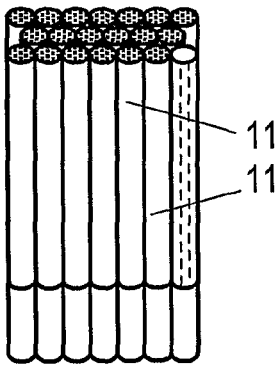
Figure 2:
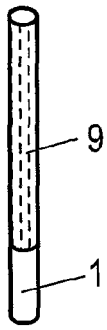
Figure 3:
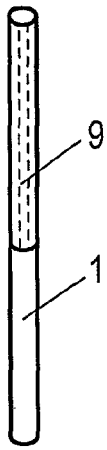
Figure 4:
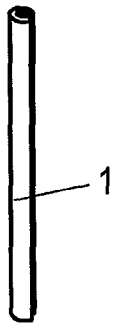
Figure 5:
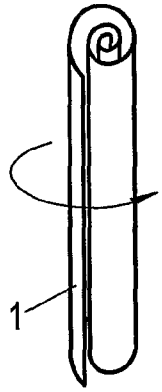
Figure 6:
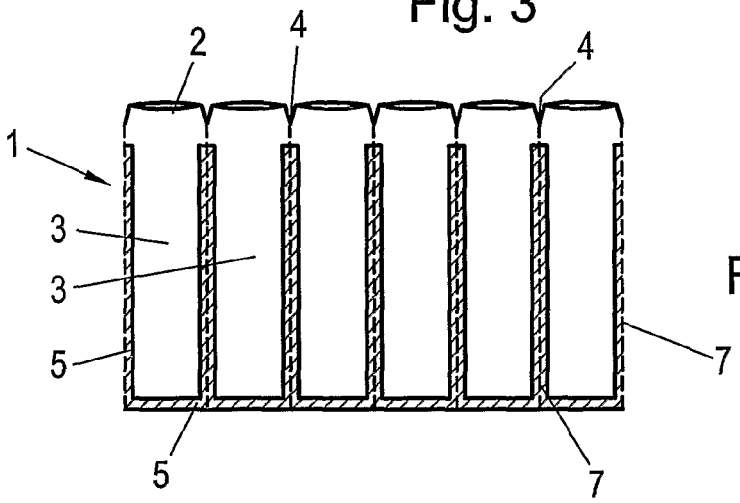
Figure 9:
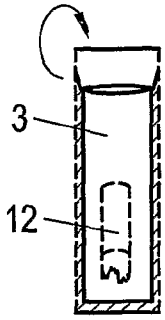
Figure 10:
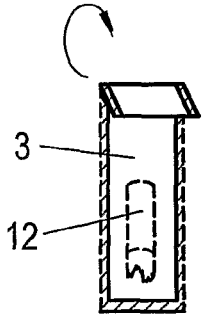
Figure 11:
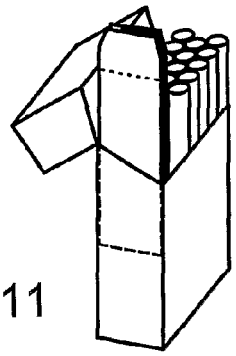
Figure 12:
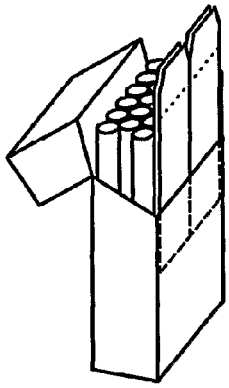
Figure 13:
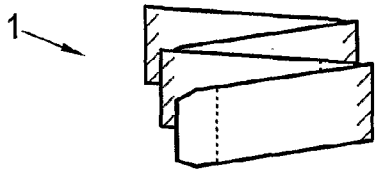
Figure 14:
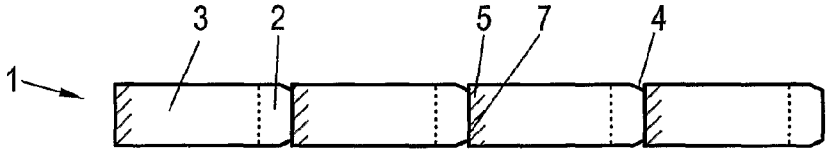
Figure 20:
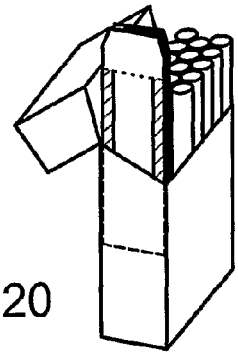
Figure 21:
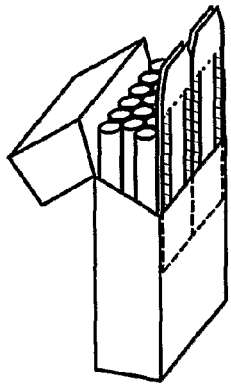
Figure 22:
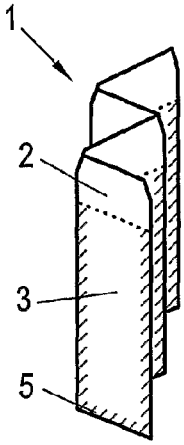
Figure 23:
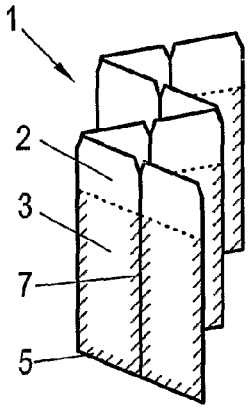
Figure 24:
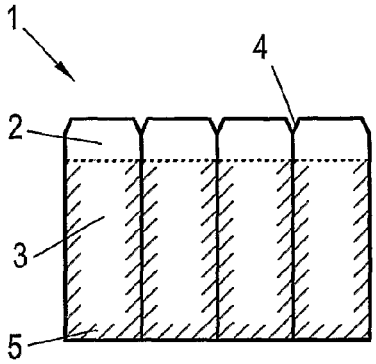
Figure 25:
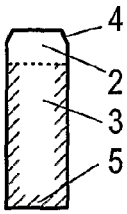

Here:

FIG. 1 diagrammatically shows cigarettes or cigarillos as they are arranged in a pack, together with an arrangement for handling cigarette or cigarillo butts, FIG. 2 shows the arrangement, as it is accommodated in a cigarette or cigarillo pack, by itself, FIG. 3 shows the preparation of the arrangement for use, FIG. 4 shows the arrangement as such with the sleeve removed, FIG. 5 shows the loosely rolled-together arrangement, FIG. 6 shows an arrangement of bags for accommodating cigarette or cigarillo butts, FIG. 7 to FIG. 10 show in stages the use of a bag of the arrangement according to the invention when handling cigarette or cigarillo butts, FIG. 11 diagrammatically shows an arrangement of cigarettes or cigarillos in a pack and another embodiment of an arrangement for handling cigarette or cigarillo butts as an enclosure in the cigarette or cigarillo pack, FIG. 12 shows the arrangements of how the latter are alternatively accommodated in a cigarette or cigarillo pack, FIG. 13 shows the preparation of the arrangement for use that is loose, hanging-together and partially unfolded, FIG. 14 shows an arrangement of bags for the accommodation of cigarette or cigarillo butts, and FIG. 15 to FIG. 19 show in stages the use of a bag of the arrangement according to the invention when handling a cigarette or cigarillo butt, FIGS. 20 and 21 diagrammatically show cigarettes or cigarillos in a pack with arrangements for handling cigarette or cigarillo butts in two additional embodiments as an enclosure in the cigarette or cigarillo pack, FIG. 22 shows the preparation of the arrangement of FIG. 20 for use, FIG. 23 shows the preparation of the arrangement of FIG. 21 for use, FIG. 24 shows the arrangement of bags that is loose, hanging-together, but unfolded for the accommodation of cigarette or cigarillo butts, and FIGS. 25 to 29 show in steps the use of a bag of the arrangement according to the invention when handling a cigarette or cigarillo butt.

One arrangement according to the invention in the embodiment shown in FIG. 6 consists of a strip 1 that has several bags 3, in particular is divided into several bags 3. Each bag 3 is formed from two layers of material that are connected to one another along three sides of the bag 3, for example by a weld or sealing seam 5, so that the bags have an access opening 10 above. As shown in FIG. 6, the bags 3 of the arrangement are connected with one another to form a strip 1, whereby the number of bags 3 is arbitrary; thus, two or more than two bags 3 can be contained in the arrangement. The bags 3 can be separated individually from the arrangement, and therefore between the bags 3, scoring lines 7, such as perforations or the like, are provided with an additional tear-off aid 4 in the form of a punched-out triangle on the upper end of the scoring lines 7. For easier opening (access opening 10), in the upper area 4 of the bag 3, the two layers of the strip 1, which can consist of two or more bags 3, are not connected either by a weld or by a sealing seam 5.

For the accommodation in a cigarette or cigarillo pack (FIG. 1), the embodiment of the arrangement according to the invention that is shown in FIGS. 1 to 5, is rolled, as shown in FIG. 5, and put into a sleeve 9, which extends over a portion of the length of the arrangement. Thus, the arrangement can be stored in a cigarette or cigarillo pack, in particular when it corresponds essentially to the dimensions of a cigarette or a cigarillo 11.

If a bag 3 is required to accommodate a cigarette or cigarillo 12 and to store it until final, proper disposal, the sleeve 9 is pulled from the arrangement (FIGS. 2, 3 and 4), the arrangement is rolled up specifically at least to the extent that the first bag 3 can be grasped for separation.

Figure 7:
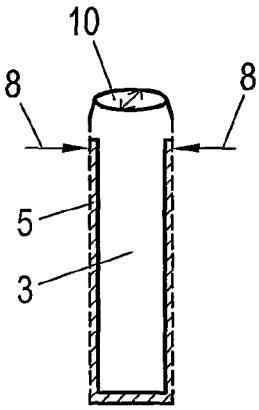
Figure 8:
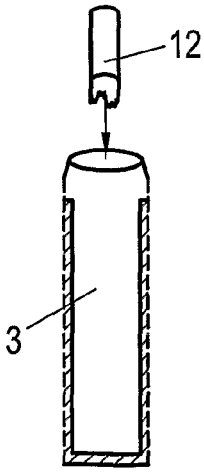

Then, the bag 3 is opened (cf. FIGS. 7 to 10) in the area of its opening 10 by pressing together the seams 5 (arrow 8 in FIG. 7). Afterwards, a cigarette or cigarillo butt 12 is put into the bag (FIG. 8). Then, the bag 3 is refolded at least once, but preferably several times, for sealing (FIGS. 9 and 10).

An environmentally safe and non-polluting handling of cigarette or cigarillo butts 12 is thus possible until they can be disposed of at a suitable disposal site.

The material of which the arrangement according to the invention consists is preferably a material that is heat-resistant, so that cigarette or cigarillo butts 12 that are not extinguished or not completely extinguished can be accommodated. For example, metal-coated, in particular aluminum-coated, paper has proven its value as material, whereby the aluminum coating comes to rest on the inside of the bag 3.

As shown in FIG. 6, each bag has an essentially rectangular outline.

In one embodiment, not shown, arrangements for sealing thereof, such as straps, or the like, can also be assigned to each bag 3 in the area of the access opening 10.

In the embodiment that is shown in FIGS. 11 to 19, the arrangement according to the invention consists of a strip 1, which has two or more bags 3, and is divided in particular into several bags 3. Each bag 3 is formed from two layers of material, which are connected to one another along three sides, for example by a weld or sealing seam 5.

In all embodiments of the invention, the bags 3 can also consist of a tube (section) that is sealed on one end, e.g., with a weld or sealing seam 5.

As shown in FIG. 14, the essentially rectangular bags 3 of the arrangement are connected to one another on their narrow sides to a strip 1, whereby the number of bags 3 is arbitrary. Thus, two or more than two bags 3 can be contained in the arrangement. The individual bags 3 can be separated from the arrangement, and therefore scoring lines 7, e.g., perforations, with an additional tear-off aid 4 in the form of a triangle that is punched out on the ends of the scoring line 7, are provided between the bags 3. For easier opening, in the upper area 2 of the bag 3, the bags 3 that are separated from the strip 1, which can consist of several bags 3, are open, i.e., the layer or the tube is not connected or sealed there either by a weld or by a sealing seam 5.

For the accommodation in a cigarette or cigarillo pack (FIGS. 11/12), the arrangement according to the invention, as shown in FIGS. 11/12, folds together flat and is used in cigarette or cigarillo packs (FIGS. 11/12). The arrangement can be stored in a cigarette or cigarillo pack in the area of its narrow side (FIG. 11), or one or two arrangements are stored in the area of the wide side (FIG. 12) of a cigarette or cigarillo pack.

When a bag 3 is required to accommodate a cigarette or cigarillo pack 12 and to store it until final, proper disposal, the arrangement is unfolded, specifically at least to the extent that the first bag 3 can be grasped for separation.

Figures 15, 16, 17, 18, 19:
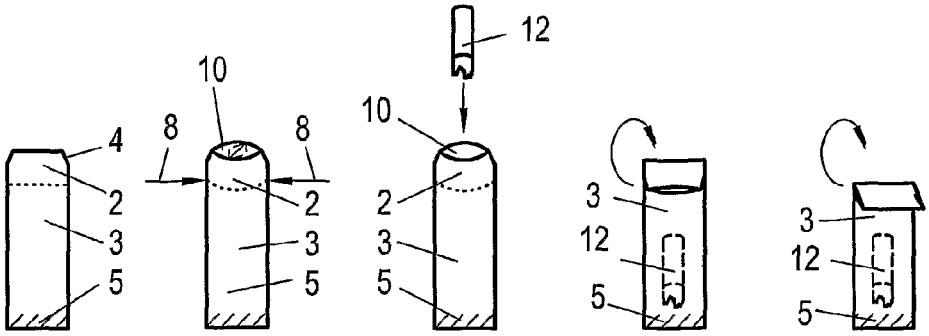

Then, (cf. FIGS. 15 to 19), the bag 3 is opened at its access opening 10 by pressing the edges together (FIG. 16). Afterwards, a cigarette or cigarillo butt 12 is put into the bag 3 (FIG. 17). Then, the bag 3 is refolded at least once, but preferably several times, for sealing (FIGS. 18 and 19).

In one embodiment, not shown, arrangements for sealing thereof, such as straps, or the like, can also be assigned to each bag 3 in the embodiment shown in FIGS. 11 to 19.

In the embodiments that are shown in FIGS. 20 to 29, the arrangement according to the invention consists of a strip 1, which has several bags 3, in particular is divided into several bags 3, whereby the bags 3 adjoin one another with their longitudinal sides. Each bag 3 is formed from two layers of material that are closed along three sides and are connected to one another, for example by a weld or sealing seam 5. As shown in FIG. 24, the bags 3 of the arrangement are connected to one another at a strip 1, whereby the number of bags 3 is arbitrary, and thus two or more than two bags 3 can be contained in the arrangement. The individual bags 3 can be separated from the arrangement, whereby between the individual bags 3, scoring lines 7, such as perforations or the like, are provided with an additional tear-off aid 4 in the form of a punched-out triangle on the ends of the scoring lines 7. For easier opening, in the upper area 2 of the bag 3, the bags 3 that are separated from strip 1, which can consist of several bags 3, are not sealed either by a weld or a sealing seam 5, so that the bags 3 have an opening 10 that lies in particular on a narrow side.

For the accommodation in a cigarette or cigarillo pack (FIGS. 20/21), the arrangement according to the invention, as shown in FIGS. 20/21, is folded flat and inserted into cigarette or cigarillo packs. Thus, the arrangement (FIG. 20) can be stored in a cigarette or cigarillo pack on its narrow side if it is folded as shown in FIG. 22. When the arrangement, i.e., the strip 1 is folded as shown in FIG. 23, the arrangement can be inserted in the area of the wide side of a cigarette or cigarillo pack 11 as shown in FIG. 21.

If a bag 3 is required to accommodate a cigarette or cigarillo butt 12 and to store it until final, proper disposal, the arrangement is unfolded specifically at least to the extent that the first bag 3 can be grasped for separation.

Figure 26:
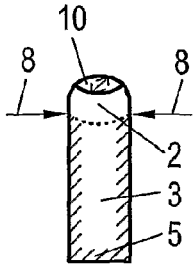
Figure 27:
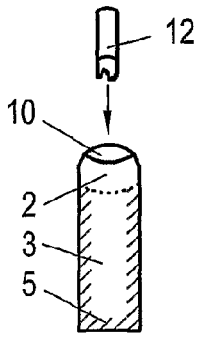
Figure 28:
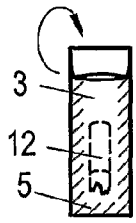
Figure 29:
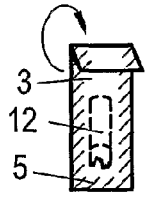

Then, (cf. FIGS. 25 to 29), the bag 3 is opened on its open side 10 by pressing together the seams 5 (FIG. 26). Afterwards, a cigarette or cigarillo butt 12 is put into the bag 3 (FIG. 27). Then, the bag 3 is refolded at least once, but preferably several times, for sealing (FIGS. 28 and 29).

In summary, a preferred embodiment of the invention can be described, for example, as follows:

An arrangement for accommodating cigarette or cigarillo butts and optionally also cigarette or cigarillo ashes comprises a strip 1 with bags 3 that are connected together and that can be separated along at least two longitudinal perforations 7 and tear-off aids 4. The strip 1 can be stored in a cigarette or cigarillo pack in rolled-up or folded form.

The invention claimed is:

1. A cigarette pack including plural cigarettes and plural cigarette butt disposal bags in a package, the cigarette pack comprising:

a rectangular cigarette package comprising two wide sides, two narrow sides, a top and a bottom;

a plurality of substantially cylindrical cigarettes or cigarillos positioned in one or more rows within the rectangular package;

a plurality of cigarette butt disposal bags, each cigarette butt disposal bag detachably connected to one or more adjacent cigarette butt disposal bags along a bag edge to form a strip of cigarette butt disposal bags, the strip of cigarette butt disposal bags being folded flat with the plurality of cigarettes or cigarillos in the rectangular package and arranged between the plurality of cigarettes or cigarillos and one of the two narrow sides of the rectangular package to form the cigarette pack, the bags being arranged one above the other.

2. The cigarette pack of claim 1, wherein each of the plural cigarette disposal bags are tubular sections closed at one end.

3. The cigarette pack of claim 1, wherein the detachable connection to one or more adjacent cigarette butt disposal bags includes scoring lines provided on at least one bag end and further comprising a tear-off aid comprising a triangular punch-out positioned between two adjacent cigarette butt disposal bags.

4. The cigarette pack of claim 1, wherein the plural cigarette disposal bags include an inner metal coating.

5. The cigarette pack of claim 1, wherein the plural cigarette disposal bags are fabricated from a metal-coated paper.

6. A cigarette pack including plural cigarettes or cigarillos and plural cigarette butt disposal bags in a package, the cigarette pack comprising:

a rectangular package comprising two wide sides, two narrow sides, a top and a bottom;

a plurality of cigarettes or cigarillos stored in the rectangular package; and a plurality of cigarette butt disposal bags, each cigarette butt disposal bag detachably connected to one or more adjacent cigarette butt disposal bags along a bag edge to form a strip of cigarette butt disposal bags, the strip of cigarette bags being folded flat with the plurality of cigarettes in the rectangular package and arranged between the plurality of cigarettes or cigarillos and one of the two wide sides of the rectangular package to form the cigarette pack, each two bags being arranged side-by-side.

7. The cigarette pack of claim 6, wherein the rectangular package is configured such that a cigarette or cigarillo of the plurality of cigarettes or cigarillos and the plurality of bags are removable from the top of the rectangular package.

8. The cigarette pack of claim 6, wherein the plurality of bags are positioned into the front wide side of the two wide sides in front of the plurality of cigarettes or cigarillos after a bag is perforatably removed from the plurality of bags.

9. The cigarette pack of claim 6, wherein each of the plurality of cigarette disposal bags are tubular sections closed at one end.

10. The cigarette pack of claim 6, wherein the detachable connection to one or more adjacent cigarette butt disposal bags includes scoring lines provided on at least one bag end and further comprising a tear-off aid comprising a triangular punch-out positioned between two adjacent cigarette butt disposal bags.

11. The cigarette pack of claim 6, wherein the plurality of cigarette disposal bags includes an inner metal coating.

12. The cigarette pack of claim 6, wherein the plurality of cigarette disposal bags is fabricated from a metal-coated paper.

13. A cigarette pack including plural cigarettes and plural cigarette butt disposal bags in a package, the cigarette pack comprising:

a rectangular cigarette package comprising two wide sides, two narrow sides, a top and a bottom;

a plurality of substantially cylindrical cigarettes or cigarillos positioned in one or more rows within the rectangular package;

a plurality of cigarette butt disposal bags, each cigarette butt disposal bag detachably connected to one or more adjacent cigarette butt disposal bags along a bag edge to form a strip of cigarette butt disposal bags, the strip of cigarette butt disposal bags rolled as a substantially cylindrical-rolled strip of cigarette butt disposal bags such that the roll of bags has an external dimension substantially similar to one of the plurality of substantially cylindrical cigarettes or cigarillos, the cylindrical roll of cigarette butt disposal bags being positioned lengthwise-adjacent at least one of the plurality of cigarettes in the rectangular cigarette package; and a sleeve positioned over the roll of bags.

14. The cigarette pack of claim 6, further comprising a sleeve positioned over the plurality of bags.

* * * * *